US009610790B2

(12) United States Patent
Suzuki et al.

(10) Patent No.: US 9,610,790 B2
(45) Date of Patent: Apr. 4, 2017

(54) LIQUID EJECTING APPARATUS

(71) Applicant: SEIKO EPSON CORPORATION, Tokyo (JP)

(72) Inventors: Manabu Suzuki, Matsumoto (JP); Tsutomu Sasaki, Matsumoto (JP); Satoru Katagami, Matsumoto (JP); Kazutoshi Fujishima, Azumino (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 15/065,625

(22) Filed: Mar. 9, 2016

(65) Prior Publication Data

US 2016/0279984 A1 Sep. 29, 2016

(30) Foreign Application Priority Data

Mar. 26, 2015 (JP) ..... 2015-064611

(51) Int. Cl.

| | |
|---|---|
| ***B41J 2/17*** | (2006.01) |
| ***B41J 29/377*** | (2006.01) |
| ***B41J 25/00*** | (2006.01) |
| ***B41J 29/02*** | (2006.01) |

(52) U.S. Cl.

CPC ..... *B41J 25/001* (2013.01); *B41J 2/1714* (2013.01); *B41J 29/02* (2013.01); *B41J 29/377* (2013.01)

(58) Field of Classification Search

CPC ..... B41J 2/1714; B41J 2/185; B41J 29/377; B41J 3/543

See application file for complete search history.

(56) References Cited

U.S. PATENT DOCUMENTS

| | | | | |
|---|---|---|---|---|
| 4,893,137 | A * | 1/1990 | Ebinuma | B41J 2/1652 346/134 |
| 5,831,655 | A * | 11/1998 | Asawa | B41J 29/377 347/102 |
| 6,281,910 | B1 * | 8/2001 | Nakano | B41J 29/377 347/34 |
| 8,305,029 | B2 * | 11/2012 | Kakutani | H02P 5/46 101/424.1 |
| 8,454,151 | B2 * | 6/2013 | Kanome | B41J 2/16552 347/102 |
| 8,708,456 | B2 * | 4/2014 | Miyata | B41J 2/1714 347/34 |

(Continued)

FOREIGN PATENT DOCUMENTS

| | | |
|---|---|---|
| EP | 2 682 267 | 1/2014 |
| JP | 2004-237691 | 8/2004 |

(Continued)

OTHER PUBLICATIONS

European Search Report for Application No. 16160661.1 dated Oct. 26, 2016.

*Primary Examiner* — Anh T. N. Vo
(74) *Attorney, Agent, or Firm* — Workman Nydegger

(57) ABSTRACT

A liquid ejecting apparatus which includes a carriage which can move in a reciprocating direction, in which the carriage is provided with an ejecting unit which ejects liquid, a circuit board which inputs a signal to the ejecting unit, and a fan which can blow air toward the circuit board, and includes a separator which separates a path through which mist which occurs along with ejecting of liquid from the ejecting unit reaches the fan.

5 Claims, 16 Drawing Sheets

(56) References Cited

U.S. PATENT DOCUMENTS

| | | | | |
|---|---|---|---|---|
| 8,876,251 | B2 * | 11/2014 | Sugimoto | B41J 2/165 347/22 |
| 2012/0062650 | A1 | 3/2012 | Kamiyama | |
| 2014/0283662 | A1 | 9/2014 | Tokura | |
| 2014/0292859 | A1 | 10/2014 | Aruga | |

FOREIGN PATENT DOCUMENTS

| | | | | |
|---|---|---|---|---|
| JP | 2007-229950 | | 9/2007 | |
| JP | 2010-58441 | * | 3/2010 | B41J 2/01 |
| JP | 2011-121277 | * | 6/2011 | B41J 2/185 |
| WO | 2014-203629 | | 12/2014 | |

* cited by examiner

LIQUID EJECTING APPARATUS

BACKGROUND

1. Technical Field

The present invention relates to a liquid ejecting apparatus.

2. Related Art

In the related art, a liquid ejecting apparatus which ejects liquid such as ink onto a medium such as a medium for recording has been disclosed. In such a liquid ejecting apparatus, there is a case in which mist of the liquid is attached to an ejecting unit of the liquid, or the like, is accumulated, and contaminates a medium by dripping on the medium. For this reason, a technology in which attaching of liquid to an ejecting unit, or the like, is suppressed is disclosed.

For example, in JP-A-2007-229950, and JP-A-2004-237691, a liquid ejecting apparatus which includes a collecting unit which collects mist of ink which occurs along with ejecting of ink from an ejecting unit is disclosed. In addition, the liquid ejecting apparatus in JP-A-2007-229950, and JP-A-2004-237691 have a configuration of performing recording by causing a carriage including an ejecting unit to reciprocate in a reciprocating direction.

Here, as a liquid ejecting apparatus with a configuration of performing recording by causing a carriage which includes an ejecting unit to reciprocate in a reciprocating direction, there is a liquid ejecting apparatus which includes an ejecting unit, a circuit board, and a carriage in which a fan which can blow air toward the circuit board is provided. The reason for this is that a temperature of the circuit board easily rises, therefore, it is possible to cool down the circuit board by providing a fan which can blow air toward the circuit board. The liquid ejecting apparatus with such a configuration has a configuration in which mist is easily blown against the circuit board due to a fan when mist occurs along with ejecting of liquid from the ejecting unit. When mist as liquid is blown against the circuit board, there is a concern that a short circuit, or the like, may be caused.

The liquid ejecting apparatuses in JP-A-2007-229950, and JP-A-2004-237691 can preferably collect mist of ink which occurs along with ejecting of ink from the ejecting unit. However, in JP-A-2007-229950 and JP-A-2004-237691, there is no description of a configuration in which an ejecting unit, a circuit board, and a carriage in which a fan which can blow air toward the circuit board are provided, that is, a configuration in which mist is easily blown against the circuit board due to the fan.

SUMMARY

An advantage of some aspects of the invention is to prevent mist of liquid which is ejected from an ejecting unit from being blown against a circuit board due to a fan, in a liquid ejecting apparatus which includes the ejecting unit, a circuit board, and a carriage in which the fan which can blow air toward the circuit board is provided.

According to an aspect of the invention, there is provided a liquid ejecting apparatus including a carriage which can move in a reciprocating direction, in which the carriage is provided with an ejecting unit which ejects liquid, a circuit board which inputs a signal to the ejecting unit, and a fan which can blow air toward the circuit board, and the carriage includes a separator which separates a path through which mist which occurs along with ejecting of the liquid from the ejecting unit reaches the fan.

In the liquid ejecting apparatus, the separator may be provided in the carriage by being arranged so as to surround a configuration unit of the fan when viewed in an ejecting direction of the liquid.

In the liquid ejecting apparatus, the separator may include convection generation units which are formed at both ends in the reciprocating direction in a shape in which at least a part thereof projects in the reciprocating direction.

In The liquid ejecting apparatus, the convection generation unit may be provided so as to extend in a direction intersecting the ejecting direction of the liquid and the reciprocating direction.

In the liquid ejecting apparatus, the separator may be provided in the carriage so that at least a part thereof is arranged between the ejecting unit and the fan, when viewed in a direction intersecting the ejecting direction of the liquid.

The liquid ejecting apparatus may further include a rail which is provided so as to extend in the reciprocating direction, in which the carriage includes a first unit which is supported by the rail, and a second unit which can move along the ejecting direction of the liquid with respect to the first unit, and the ejecting unit and the separator are provided in the second unit.

According to the invention, in a liquid ejecting apparatus which includes a carriage in which an ejecting unit, a circuit board, and a fan which can blow air toward the circuit board are provided, it is possible to prevent mist of liquid which is ejected from the ejecting unit from being blown against the circuit board due to the fan.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, a recording apparatus according to one embodiment as a liquid ejecting apparatus of the invention will be described in detail with reference to accompanying drawings.

First, an outline of a recording apparatus 1 according to the embodiment of the invention will be described.

Figure 1:
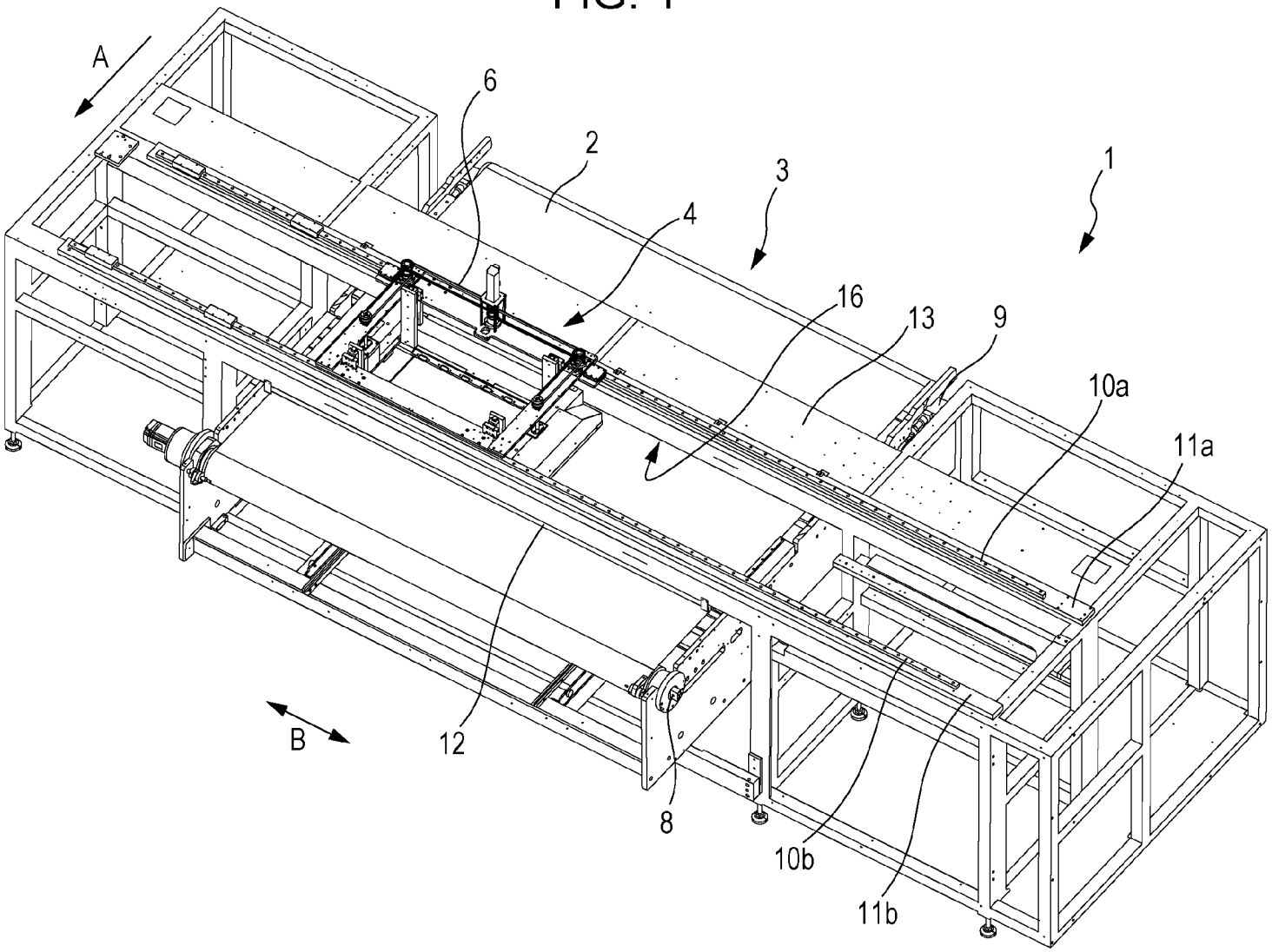
FIG. 1 is a schematic perspective view which illustrates a recording apparatus according to one embodiment of the invention.
Figure 2:
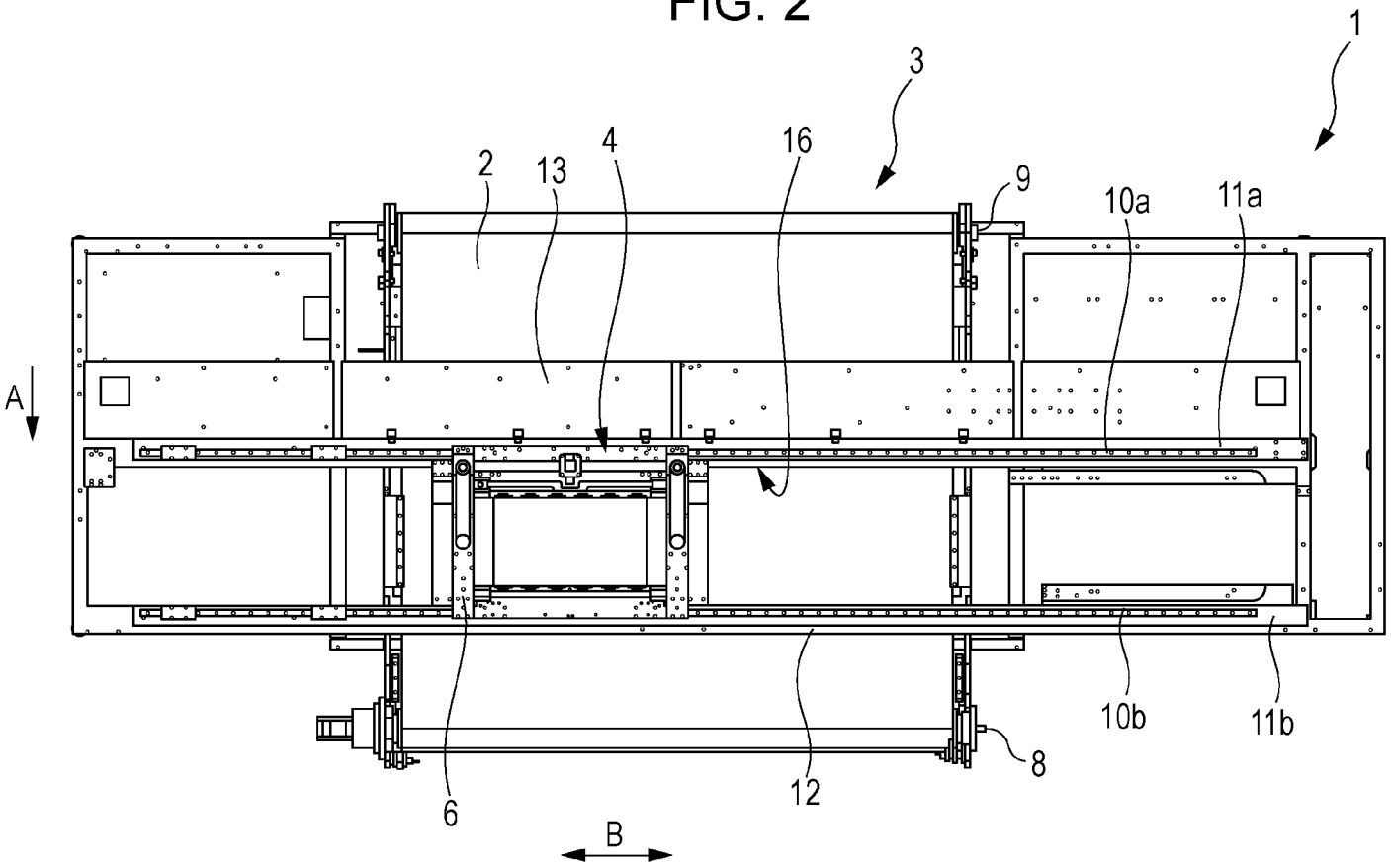
FIG. 2 is a schematic plan view which illustrates the recording apparatus according to the embodiment of the invention.
Figure 3:
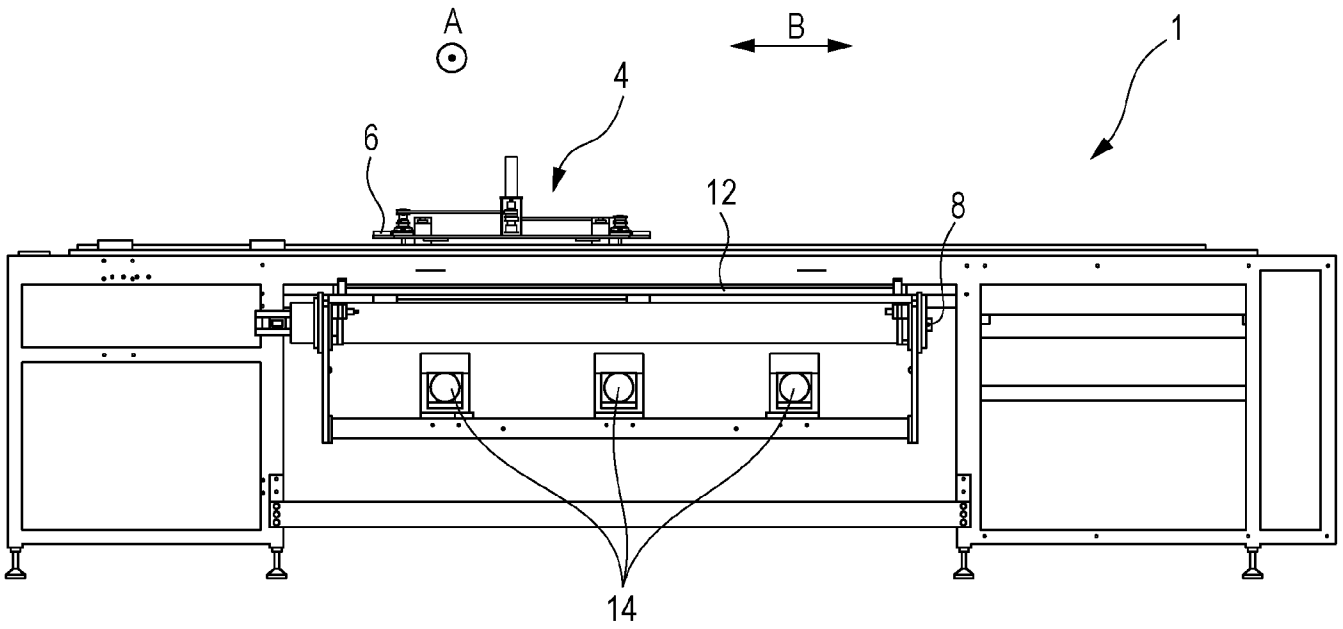
FIG. 3 is a schematic front view which illustrates the recording apparatus according to the embodiment of the invention.
Figure 4:
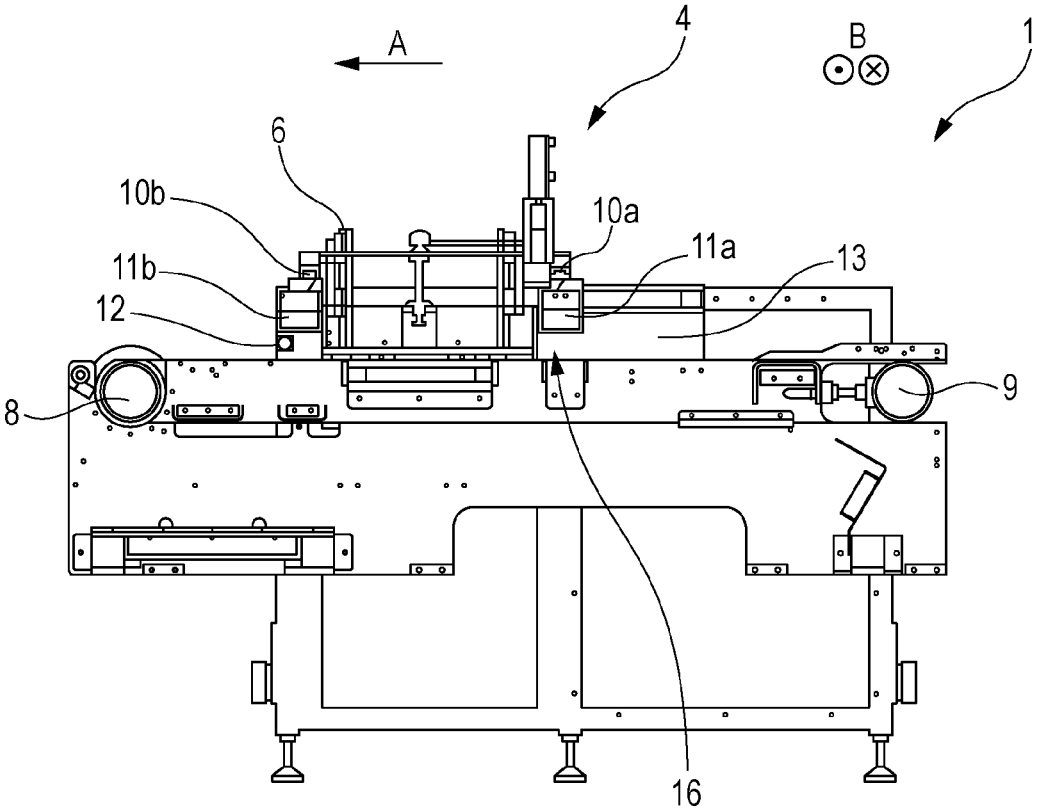
FIG. 4 is a schematic side view which illustrates the recording apparatus according to the embodiment of the invention.
Figure 5:
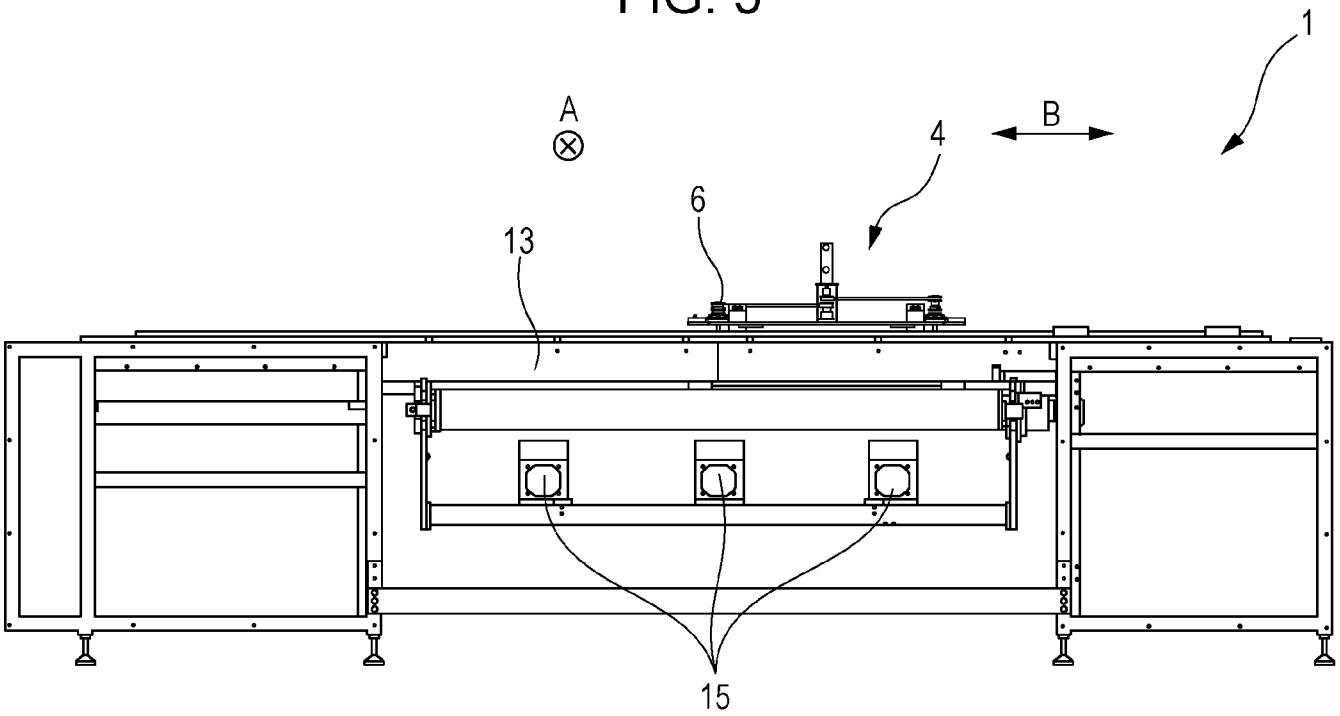
FIG. 5 is a schematic rear view which illustrates the recording apparatus according to the embodiment of the invention.
Figure 6:
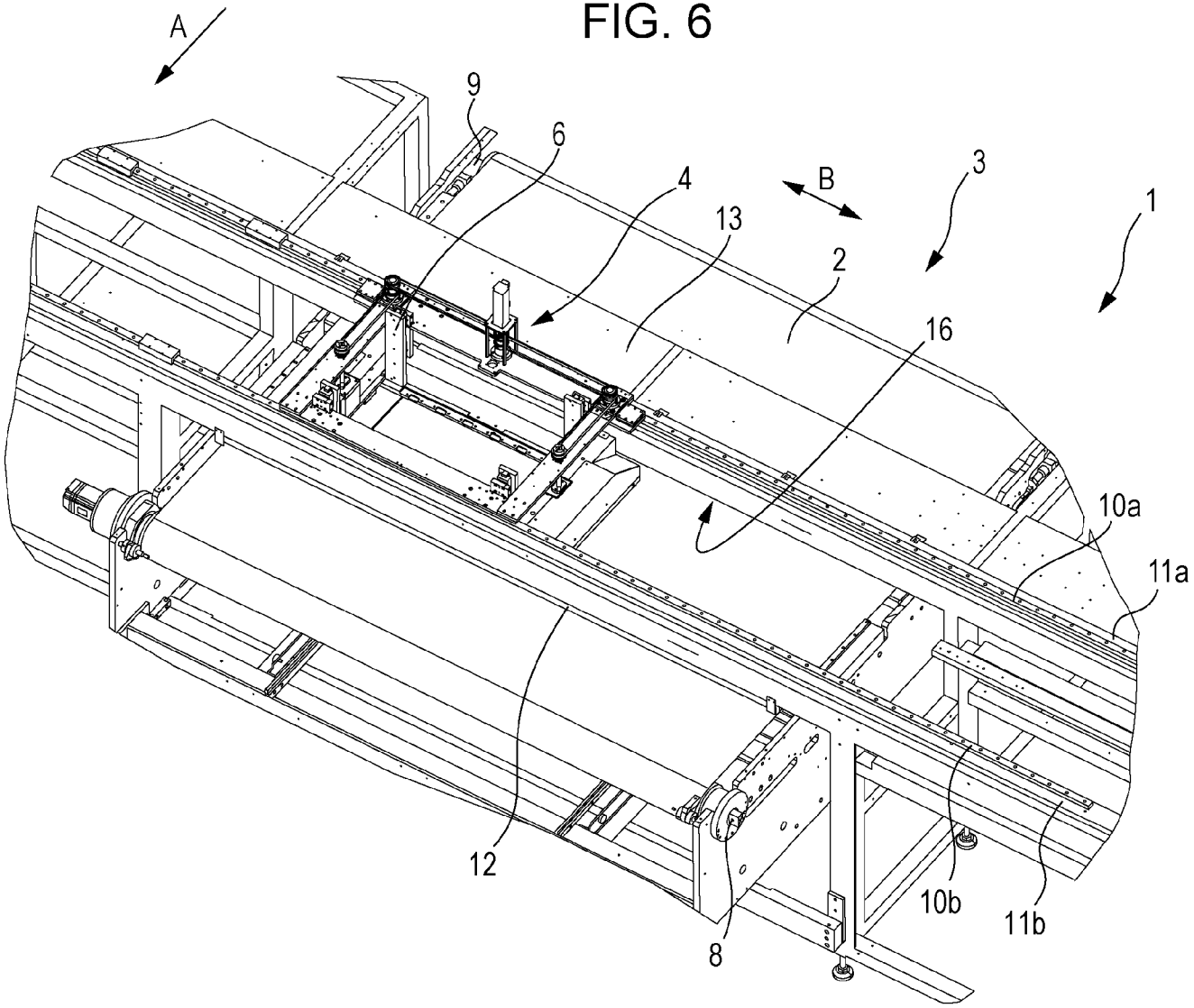
FIG. 6 is a schematic perspective view which illustrates main portions of the recording apparatus according to the embodiment of the invention.

FIG. 1 is a schematic perspective view of a recording apparatus 1 according to the embodiment. FIG. 2 is a schematic plan view of the recording apparatus 1 according to the embodiment. FIG. 3 is a schematic front view of the recording apparatus 1 according to the embodiment. FIG. 4 is a schematic side view of the recording apparatus 1 according to the embodiment. FIG. 5 is a schematic rear view of the recording apparatus 1 according to the embodiment. In addition, FIG. 6 is a schematic perspective view which illustrates the periphery of a recording region which is main portions of the recording apparatus 1 according to the embodiment. In addition, FIGS. 1 to 6 illustrate a state in which a part of constituent elements is detached from the recording apparatus 1 according to the embodiment, and for example, illustrate a state in which a sub-carriage 5 (refer to FIG. 13) including a recording head 7 (refer to FIG. 12) is detached from a carriage 6.

The recording apparatus 1 according to the embodiment includes a transport mechanism 3 which transports a medium for recording in a transport direction A using an adhesive belt 2 (endless belt) which supports the medium for recording (medium) on a support face to which an adhesive is attached. The recording apparatus further includes a feeding unit (not illustrated) on which a medium for recording in a roll shape can be set, and can feed the medium for recording to the transport mechanism 3. The recording apparatus further includes a recording mechanism 4 which performs recording by causing the carriage 6 which includes the recording head 7 as the ejecting unit to perform reciprocating scanning in a reciprocating direction B which intersects the transport direction A, in a transport region of the medium for recording using the transport mechanism 3. The recording apparatus further includes a winding mechanism (not illustrated) which can winds up the medium for recording on which recording is performed in the recording mechanism 4.

The transport mechanism 3 according to the embodiment includes the adhesive belt 2 which transports the medium for recording which is fed from the feeding unit by mounting the medium for recording thereon, a driving roller 8 which moves the adhesive belt 2, and a driven roller 9. The medium for recording is mounted on a support face of the adhesive belt 2 by being attached.

However, an endless belt as a transport belt is not limited to the adhesive belt. For example, an electrostatic suctioning-type endless belt may be used.

The recording apparatus 1 according to the embodiment includes the transport mechanism 3 with such a configuration; however, it is not limited to the transport mechanism with such a configuration, and may be a transport mechanism with a configuration in which a medium for recording is transported by being supported by a movable support tray, or the like, or a configuration in which a medium for recording is transported using a pair of rollers, or the like. In addition, it may be a recording apparatus of a so-called flatbed type in which recording is performed by fixing a medium for recording to a support unit, and a recording head 7 is moved with respect to the fixed medium for recording.

The recording mechanism 4 includes a carriage motor 30 (refer to FIG. 7) which causes the carriage 6 which includes the recording head 7 which can eject ink (liquid) to reciprocate in the reciprocating direction B.

The recording apparatus 1 according to the embodiment performs recording by causing the carriage 6 which includes the recording head 7 to perform reciprocating scanning when performing recording; however, the transport mechanism 3 stops transporting of the medium for recording in the middle of recording scanning (in the middle of moving of carriage 6). In other words, when performing recording, reciprocating scanning of the carriage 6, and transporting of the medium for recording are alternately performed. That is, when performing recording, the transport mechanism 3 causes the medium for recording to be intermittently transported (intermittent movement of adhesive belt 2) corresponding to reciprocating scanning of the carriage 6.

In addition, a rail 10*a* which extends in the reciprocating direction B is formed in a pipe 11*a* which configures a skeleton portion of the recording apparatus 1 according to the embodiment, and a rail 10*b* which extends in the reciprocating direction B is formed in a pipe 11*b* which configures a skeleton portion of the recording apparatus 1 according to the embodiment. In addition, a movement of the carriage 6 according to the embodiment in the reciprocating direction B is guided by the rails 10*a* and 10*b*, since bearing units (not illustrated) are received in the rails 10*a* and 10*b*.

In addition, an air blowing unit 12 which extends in the reciprocating direction B, and blows air in a direction opposite to the transport direction A from a plurality of vents (not illustrated) is provided at a position on the lower part of the pipe 11*b*. In addition, a mist collecting unit 13 which extends in the reciprocating direction B, and can collect mist of ink which is ejected from the recording head 7 is provided at a position on the lower part of the pipe 11*a*. In addition, a collecting port 16 which extends in the reciprocating direction B is provided in the mist collecting unit 13 at the position on the lower part of the pipe 11*a*.

In addition, as illustrated in FIG. 3, a plurality of blower fans 14 (three) which generate a blasting force using the air blowing unit 12 are provided on the downstream side of the recording apparatus 1 according to the embodiment in the transport direction A. The air blowing unit 12 can blow air toward the collecting port 16 from the outside (position on downstream side in transport direction A) of the collecting unit 13 using the blast force which is generated by the blower fan 14. In addition, as illustrated in FIG. 5, a plurality of (three) suctioning fans 15 as a suctioning unit which generate an air current toward the inside of the collecting unit 13 from the collecting port 16, and toward the outside of the recording apparatus 1 from the inside of the collecting unit 13 are provided on the upstream side of the recording apparatus 1 according to the embodiment in the transport direction A.

Subsequently, an electrical configuration of the recording apparatus 1 according to the embodiment will be described.

Figure 7:
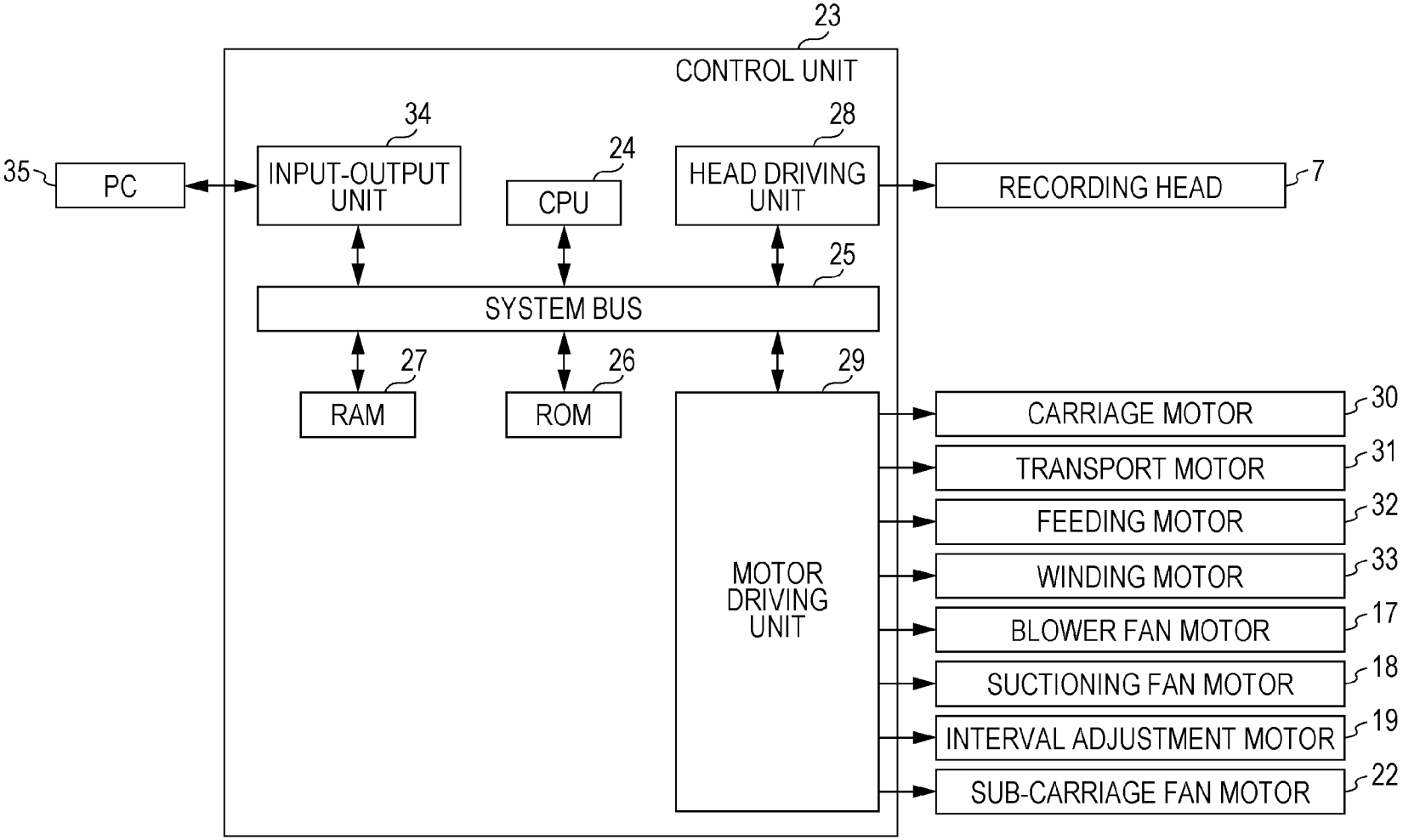
FIG. 7 is a block diagram which illustrates the recording apparatus according to the embodiment of the invention.

FIG. 7 is a block diagram of the recording apparatus 1 according to the embodiment.

A CPU 24 which is in charge of the entire control of the recording apparatus 1 is provided in a control unit 23. The CPU 24 is connected to a ROM 26 which stores various control programs, and the like, which are executed by the CPU 24, and a RAM 27 which can temporarily store data through a system bus 25.

In addition, the CPU 24 is connected to a head driving unit 28 which drives the recording head 7 through the system bus 25.

In addition, the CPU 24 is connected to a motor driving unit 29 for driving the carriage motor 30, a transport motor 31, a feeding motor 32, a winding motor 33, a blower fan motor 17, a suctioning fan motor 18, an interval adjustment motor 19, and sub-carriage fan motor 22 through the system bus 25.

Here, the carriage motor 30 is a motor for moving the carriage 6 including the recording head 7. In addition, the transport motor 31 is a motor for driving the driving roller 8. The feeding motor 32 is a driving motor of a feeding unit for sending a medium for recording which is set in the feeding unit to the transport mechanism 3. The winding motor 33 is a driving motor for driving a winding mechanism so as to wind up a medium for recording on which recording is performed. The blower fan motor 17 is a motor for driving the blower fan 14. The suctioning fan motor 18 is a motor for driving the suctioning fan 15. In addition, the interval adjustment motor 19 is a motor for driving an interval adjustment unit 20 (refer to FIG. 8) which adjusts an interval between a recording head 7 which will be described later and a medium for recording. In addition, the sub-carriage fan motor 22 is a motor for driving a sub-carriage fan 21 (refer to FIG. 13), which will be described later, which can blow air toward the circuit board.

In addition, the CPU 24 is connected to an input-output unit 34 through the system bus 25, and the input-output unit 34 is connected to a PC 35 for performing transceiving of data such as recording data, and a signal.

Subsequently, the carriage 6 of the recording apparatus 1 according to the embodiment will be described.

Figure 8:
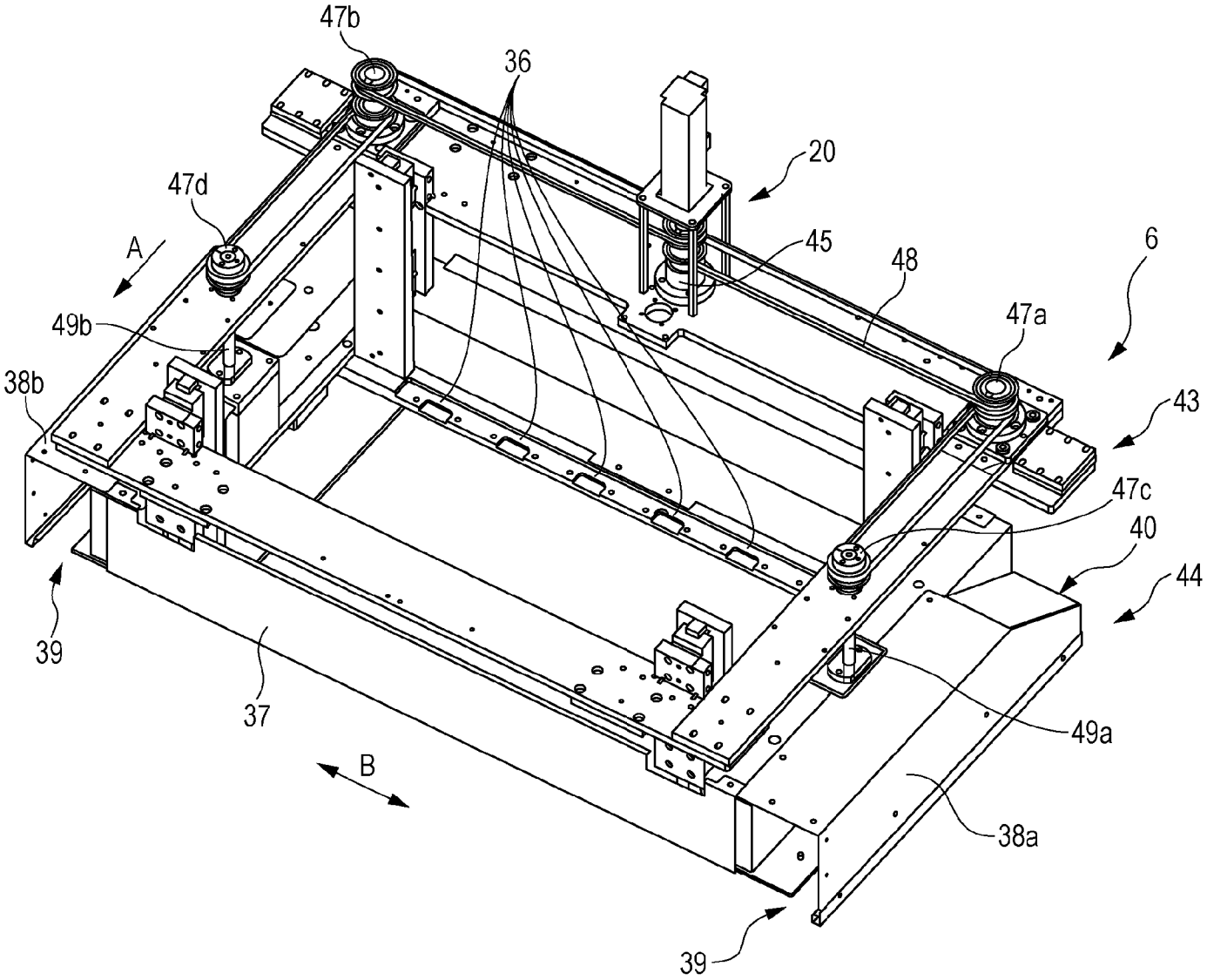
FIG. 8 is a schematic perspective view which illustrates a carriage of the recording apparatus according to the embodiment of the invention.
Figure 9:
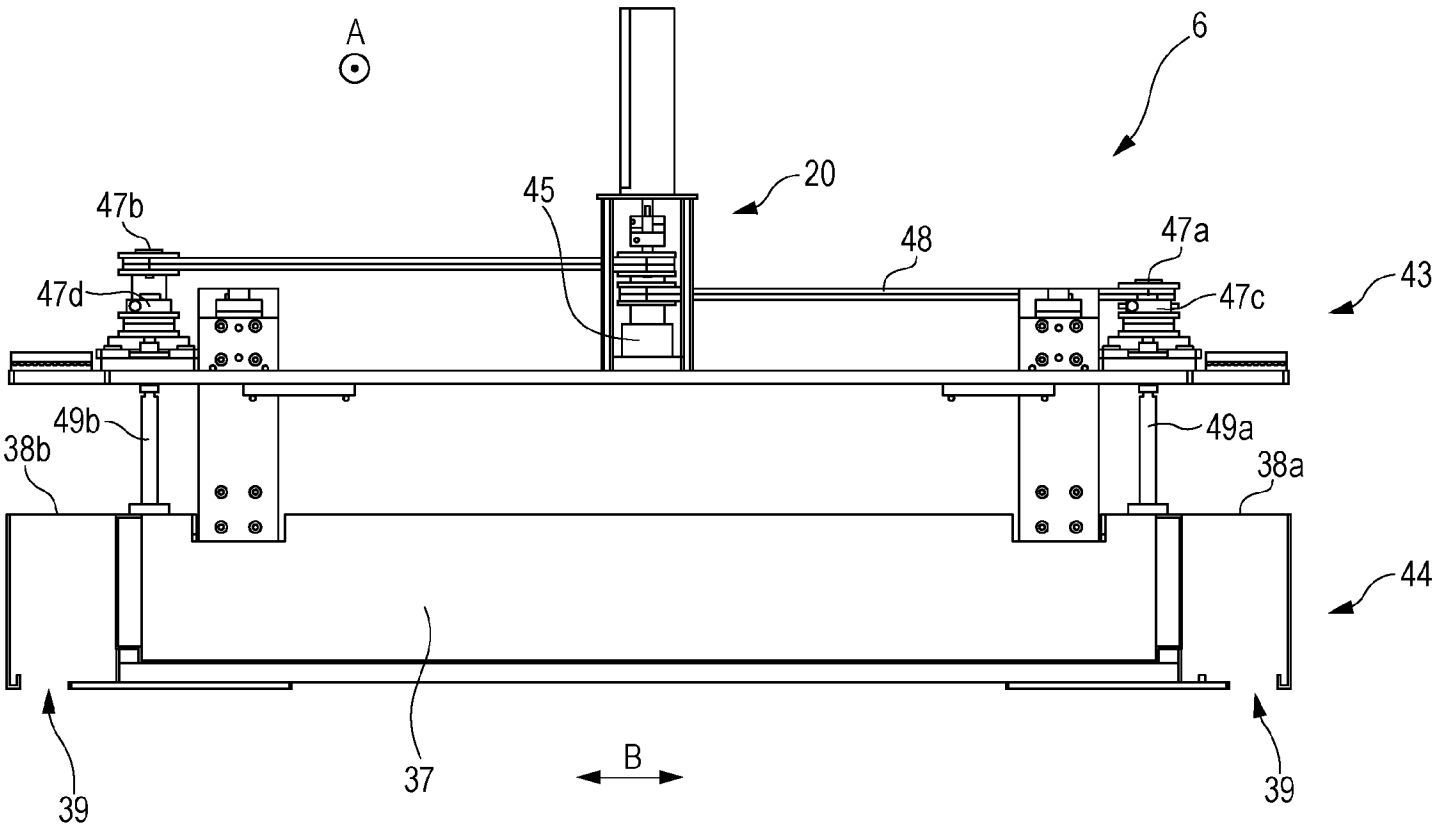
FIG. 9 is a schematic front view which illustrates the carriage of the recording apparatus according to the embodiment of the invention.
Figure 10B:
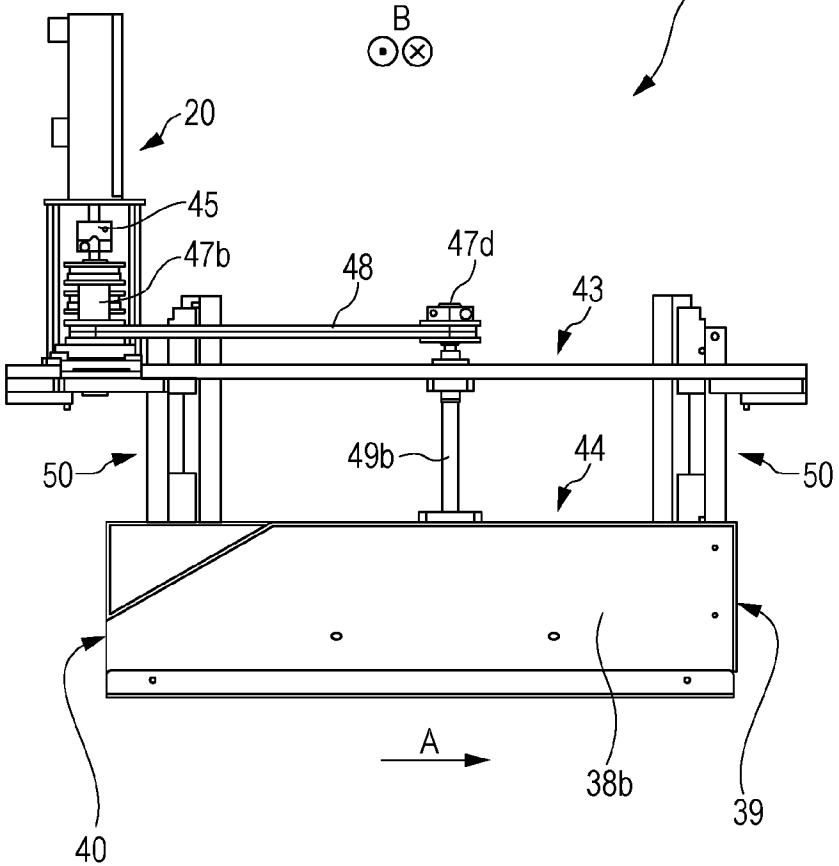
FIGS. 10A and 10B are schematic side views which illustrate the carriage of the recording apparatus according to the embodiment of the invention.
Figure 10A:
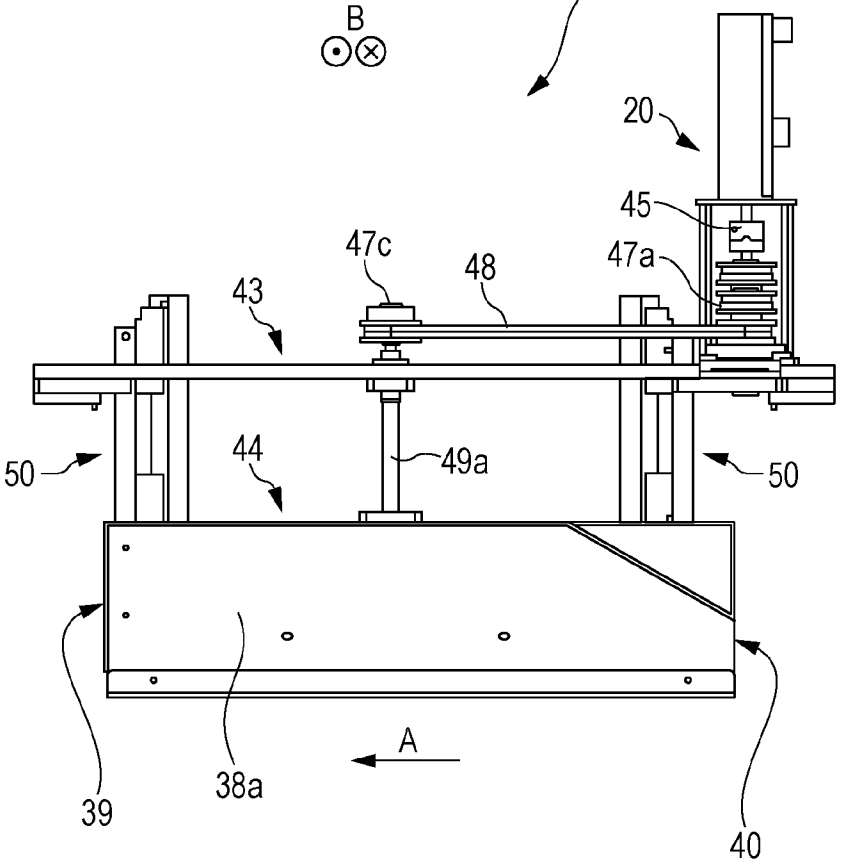
Figure 11:
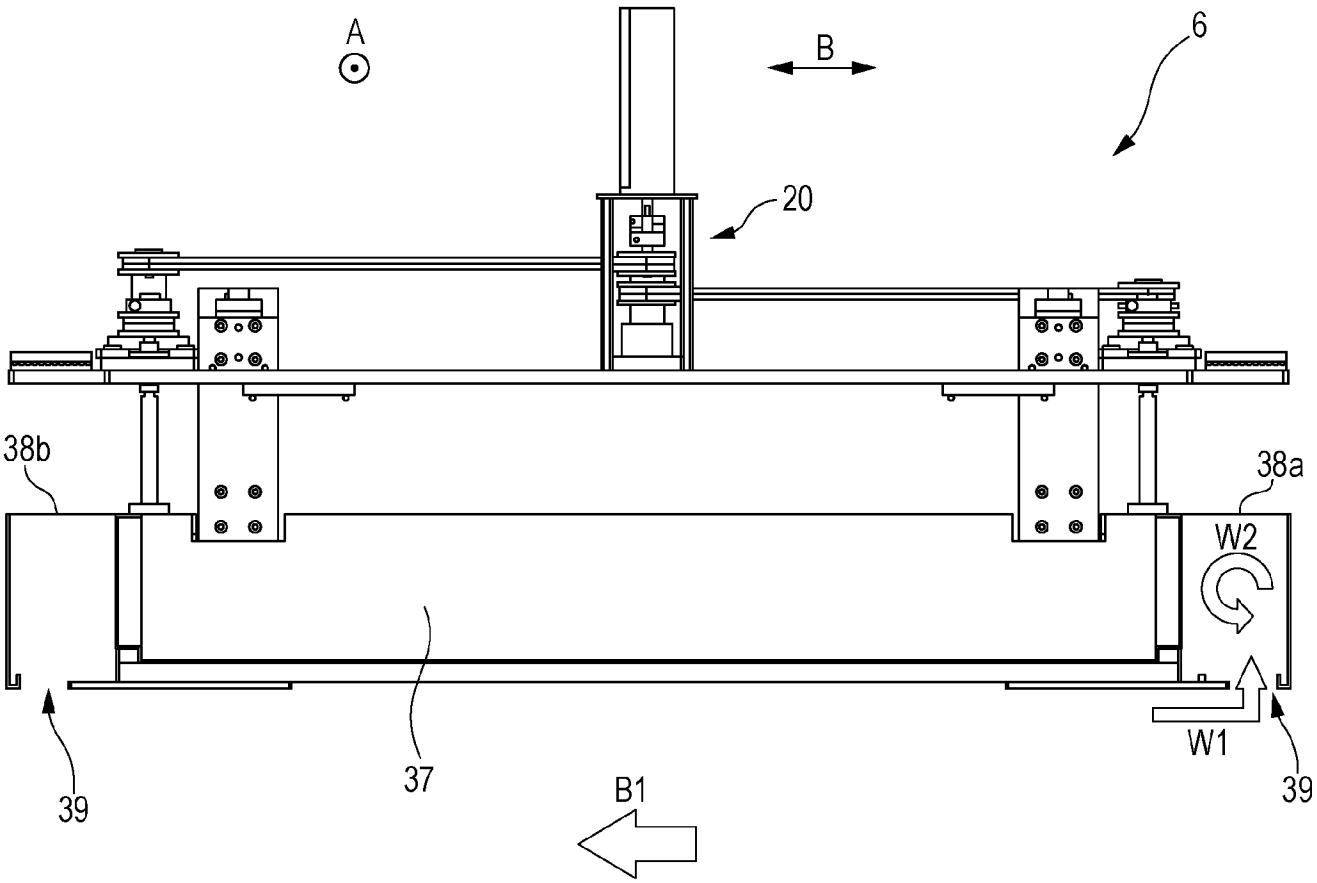
FIG. 11 is a schematic front view which illustrates the carriage of the recording apparatus according to the embodiment of the invention.
Figure 12:
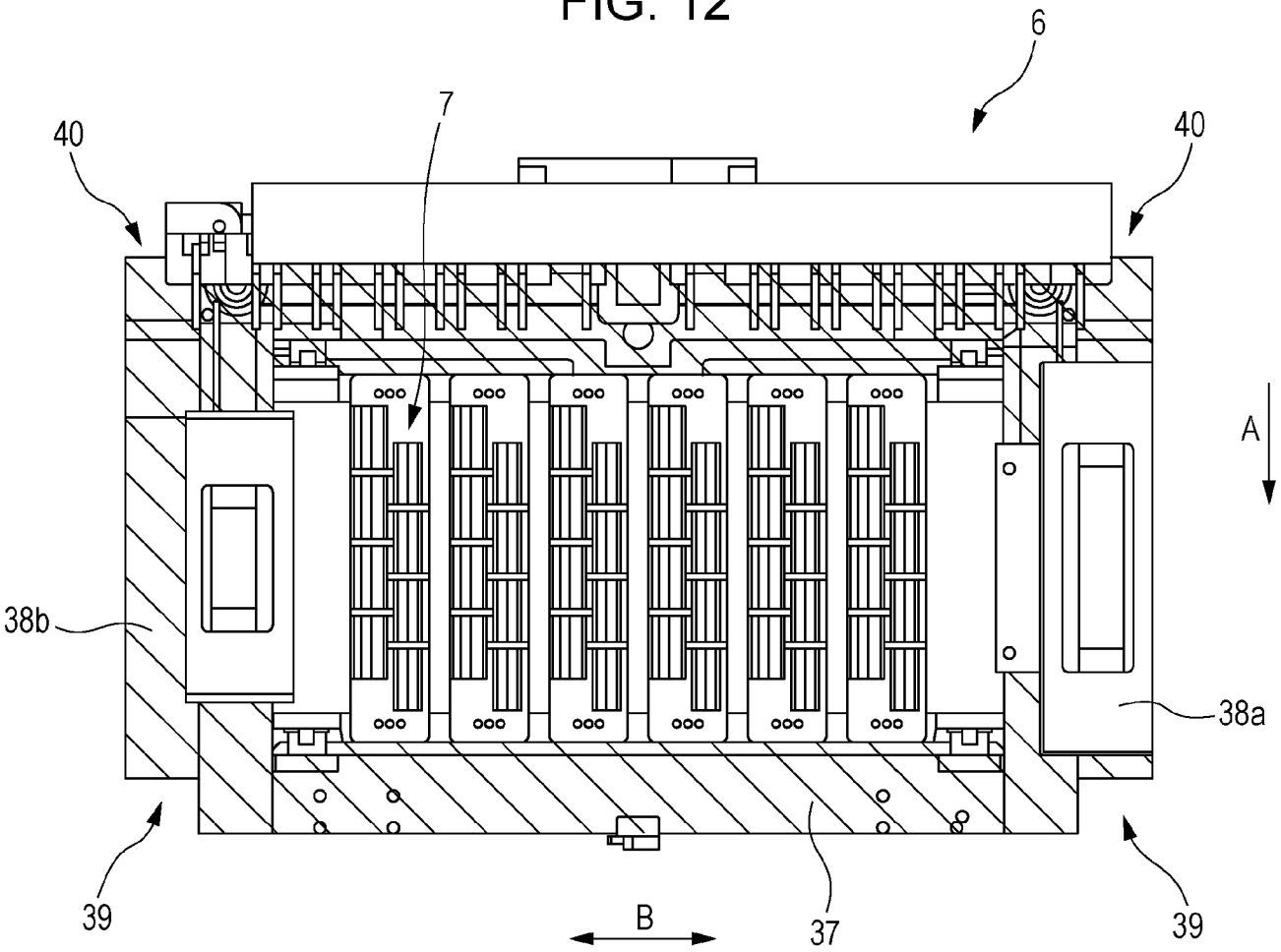
FIG. 12 is a schematic plan view which illustrates the carriage of the recording apparatus according to the embodiment of the invention.
Figure 13:
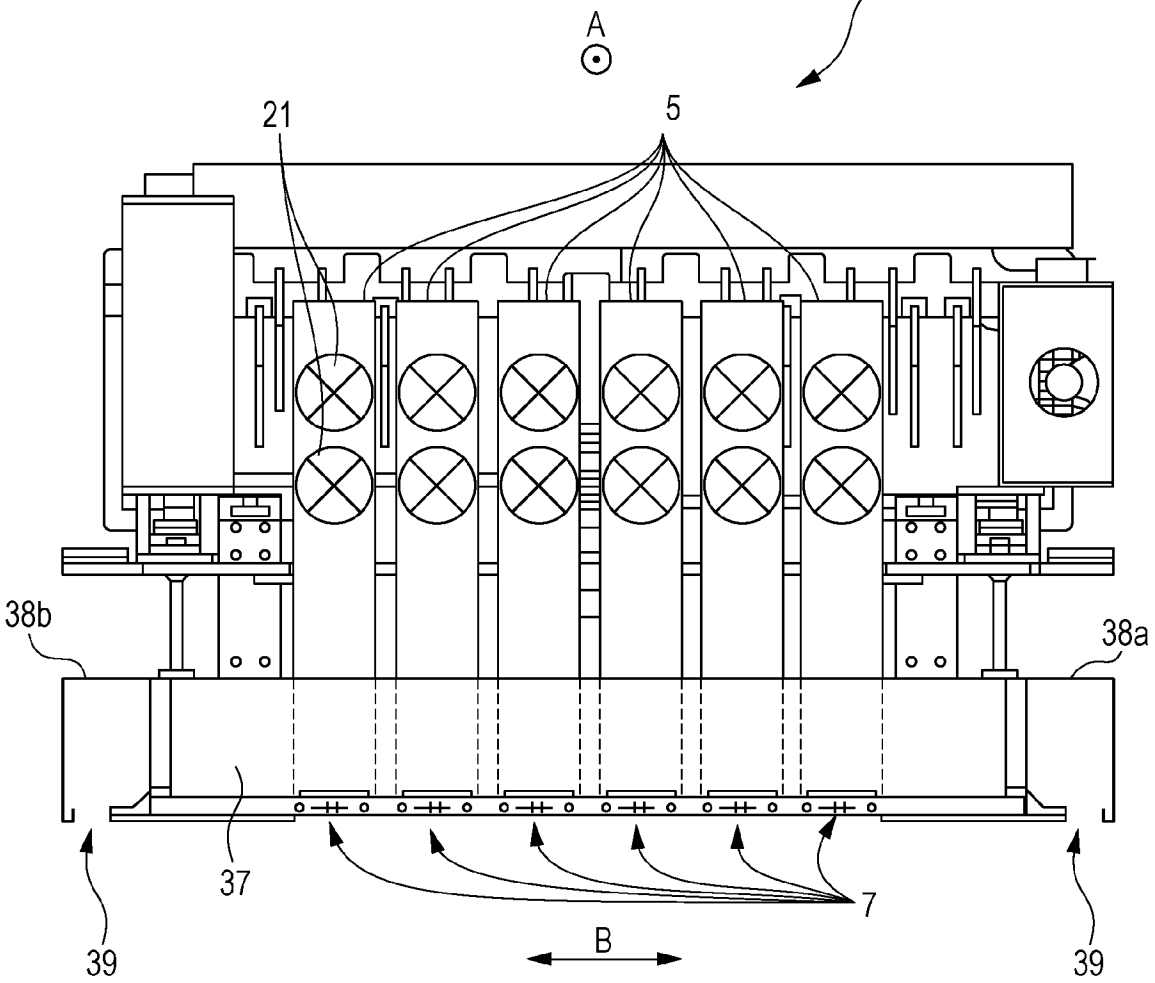
FIG. 13 is a schematic front view which illustrates the carriage of the recording apparatus according to the embodiment of the invention.
Figure 14:
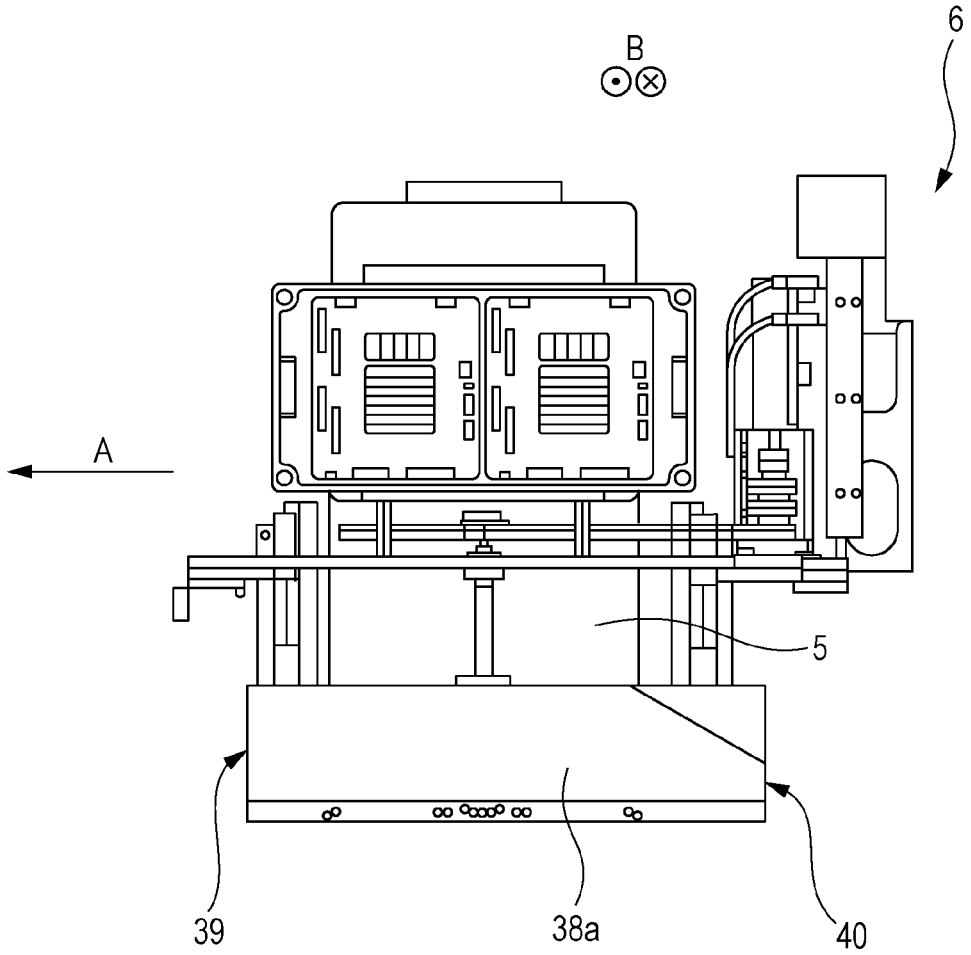
FIG. 14 is a schematic side view which illustrates the carriage of the recording apparatus according to the embodiment of the invention.

FIGS. 8 to 14 illustrate schematic views of the carriage 6 according to the embodiment. Among these, FIG. 8 illustrates a schematic perspective view of the carriage 6 according to the embodiment, FIGS. 9, 11, and 13 illustrate schematic front views of the carriage 6 according to the embodiment, FIGS. 10 and 14 illustrate schematic side views of the carriage 6 according to the embodiment, and FIG. 12 illustrates a schematic plan view of the carriage 6 according to the embodiment. In addition, FIGS. 8 to 11 illustrate a state in which a part of constituent elements, for example, a sub-carriage 5 including the recording head 7 is detached from the carriage 6. In addition, FIGS. 12 to 14 illustrate a state in which a plurality of the sub-carriages 5 including the recording head 7 are attached to the carriage 6, and FIG. 12 is set to a perspective view so that it is possible to understand arrangements of the plurality of recording heads 7 which are provided in each sub-carriage 5. In addition, FIG. 10A in FIGS. 10A and 10B is a schematic side view on the right side when viewing the carriage 6 on the front side, and FIG. 10B is a schematic side view on the left side when viewing the carriage 6 on the front side.

As illustrated in FIGS. 12 and 13, a plurality of (six) the sub-carriages 5 can be attached to the carriage 6 according to the embodiment. In addition, as illustrated in FIG. 8, an attaching unit 36 of the sub-carriage 5 is provided in the carriage 6 according to the embodiment. In addition, as illustrated in FIG. 12, the plurality of recording heads 7 are arranged in a staggered manner in each sub-carriage 5. In addition, a substrate (circuit board) (not illustrated), or the like, is formed in each sub-carriage 5, in addition to the plurality of recording heads 7, and the sub-carriage fan 21 for cooling the substrate is provided in the sub-carriage.

Since the sub-carriage fan 21 suppresses an increase in temperature in the sub-carriage 5 by blowing (blowing air to circuit board) an air current in the inside of the sub-carriage 5, when mist of ink is present around the sub-carriage fan 21, the mist is sent to the inside of the sub-carriage 5, and there is a concern that the mist may be attached to the circuit board.

For this reason, as described above, the air blowing unit 12 and the collecting unit 13 are provided in the recording apparatus 1 according to the embodiment so as to prevent mist from being supplied to the inside of the sub-carriage 5; however, the separator 37 for suppressing mist which occurs along with ejecting of ink from the recording head 7 reaches the sub-carriage fan 21 is further provided. The separator 37 takes a role of dividing a region on the downstream side of the recording head 7 in the ejecting direction of ink in which much mist exist, and a region on the upstream side of the recording head 7 in the ejecting direction of ink in which a small amount of mist exist. That is, the separator 37 takes a role of separating a path through which mist which occurs along with ejecting of ink from the recording head 7 reaches the sub-carriage fan 21.

As illustrated in FIGS. 8, 9, 11, 12, and 13, a frame-shaped separator 37 for suppressing attaching of mist of ink which is ejected from the recording head 7, which flies up to the higher part, to the sub-carriage 5 is provided. The frame-shaped separator 37 takes a role of suppressing flying up of mist by separating the region with mist of a small amount on the upper side of the sub-carriage 5 from the region with a lot of mist which is close to the recording head 7. In other words, the separator 37 takes a role of maintaining a region in the vicinity of the sub-carriage fan 21 at a region with mist of a small amount by lengthening a movement path of mist from the recording head 7 to the sub-carriage fan 21.

In conclusion, the recording apparatus 1 according to the embodiment includes the carriage 6 which can move in the reciprocating direction B. In addition, the carriage 6 is provided with the sub-carriage 5 which includes the recording head 7 which ejects ink, the circuit board which inputs an electrical signal (that is, ejecting data (recording data) of ink) to the recording head 7, and the sub-carriage fan 21 which can blow air toward the circuit board. In addition, the carriage 6 includes the separator 37 which separates a path through which mist which occurs along with ejecting of ink from the recording head 7 reaches the sub-carriage fan 21. In addition, "separating a path to the sub-carriage fan 21" means that it is enough when mist which reaches the sub-carriage fan 21 is reduced by providing the separator 37, even if it is not possible to completely prevent mist from reaching the sub-carriage fan 21.

For this reason, the recording apparatus 1 according to the embodiment has a configuration in which it is possible to prevent mist of ink which is ejected from the recording head 7 from reaching the sub-carriage fan 21. Accordingly, the recording apparatus 1 according to the embodiment can suppress mist of ink which is ejected from the recording head 7 is blown against the circuit board due to the sub-carriage fan 21.

In addition, as illustrated in a hatched portion in FIG. 12, the separator 37 according to the embodiment is provided in the carriage 6 in an arrangement of surrounding the sub-carriage 5 as a configuration unit of the sub-carriage fan 21 when viewed in a vertical direction (in planar view) which is the ejecting direction of ink. For this reason, the recording apparatus 1 according to the embodiment has a configuration in which it is possible to prevent mist of ink ejected from the recording head 7 from reaching the sub-carriage fan 21 in all directions which intersect the ejecting direction of ink. Accordingly, the recording apparatus 1 according to the embodiment can preferably prevent mist of ink ejected from the recording head 7 from being blown against the circuit board due to the sub-carriage fan 21.

In as illustrated in FIGS. 8 to 14, the separator 37 according to the embodiment includes convection generation units 38*a* and 38*b* which are formed at both ends in the reciprocating direction B in a shape in which at least a part thereof projects in the reciprocating direction B.

Here, as illustrated in FIG. 11, for example, an air current W1 is generated on the rear side in the direction B1 in the reciprocating direction B, when the carriage 6 is moving in the direction B1 in the reciprocating direction B. In addition, as illustrated in FIG. 11, when the carriage 6 is moving in the direction B1, convection W2 is generated in the convection generation unit 38*a* on the rear side in the direction B1 of the separator 37 along with the movement. That is, it is a configuration in which the convection generation units 38*a* and 38*b* catch mist when moving the carriage 6, and it is possible to suppress diffusion of mist. Accordingly, the recording apparatus 1 according to the embodiment can preferably prevent mist of ink ejected from the recording head 7 from being blown against the circuit board due to the sub-carriage fan 21.

In addition, as illustrated in FIGS. 10A and 10B, and the like, the convection generation units 38*a* and 38*b* according to the embodiment are provided so as to extend along the transport direction A which is a direction intersecting the ejecting direction of ink and the reciprocating direction B. For this reason, the separator 37 is configured so as to preferably suppress diffusion of mist by generating convection along the transport direction A using the convection generation units 38*a* and 38*b* on the rear side in the reciprocating direction B. Accordingly, the recording apparatus 1 according to the embodiment can preferably prevent mist of ink ejected from the recording head 7 from being blown against the circuit board due to the sub-carriage fan 21, particularly.

In addition, as illustrated in FIGS. 8, 10A and 10B, and 14, the convection generation units 38*a* and 38*b* according to the embodiment include opening portions 39 and 40 on the downstream side and the upstream side in the transport direction A, and are formed in a tapered shape in which a length in the height direction becomes small toward the opening portion 40 on the upstream side in the transport direction A; however, it is not limited to such a configuration.

In addition, as illustrated in FIG. 13, the separator 37 according to the embodiment is provided in the carriage 6 so as to include a position between the recording head 7 and the sub-carriage fan 21 when viewed in the horizontal direction. In other words, at least a part of the separator is formed in the carriage 6 by being arranged between the recording head 7 and the sub-carriage fan 21 when viewed in a direction intersecting the ejecting direction of ink. For this reason, the recording apparatus 1 according to the embodiment has a configuration in which it is possible to preferably prevent mist of ink which is ejected from the recording head 7 from reaching the sub-carriage fan 21. Accordingly, the recording apparatus 1 according to the embodiment can preferably prevent mist of ink which is ejected from the recording head 7 from being blown against the circuit board due to the sub-carriage fan 21.

In addition, the recording apparatus 1 according to the embodiment can perform recording on a medium for recording of various types, and to adjust an interval between the recording head 7 and a medium for recording (or, interval between recording head 7 and support unit of medium for recording) according to a type of a medium for recording to be used. That is, it is possible to vertically move a position of the recording head 7.

Specifically, as described above, the recording apparatus 1 according to the embodiment includes rails 10*a* and 10*b* which are provided so as to extend in the reciprocating direction B. In addition, the carriage 6 includes a first unit 43 which is supported by the rails 10*a* and 10*b*, and a second unit 44 which can move along a vertical direction which is the ejecting direction of ink with respect to the first unit 43 by driving the interval adjustment unit 20.

The recording head 7 is provided in the second unit 44. With such a configuration, it is possible to vertically move a position of the recording head 7 by causing the second unit 44 to move along the vertical direction which is the ejecting direction of ink with respect to the first unit 43. The recording apparatus 1 according to the embodiment can adjust the interval between the recording head 7 and the medium for recording (or, interval between recording head 7 and support unit of medium for recording) by adopting such a configuration.

In addition, also the separator 37 is provided in the second unit 44. For this reason, a positional relationship between the recording head 7 and the separator 37 is maintained even when the interval is adjusted, and it is possible to preferably prevent mist of ink which is ejected from the recording head 7 from reaching the sub-carriage fan 21, even when the interval is adjusted.

Here, as illustrated in FIGS. 10A and 10B, the second unit 44 is suspended so as to move in the vertical direction with respect to the first unit 43 which is supported by the rails 10*a* and 10*b* using a guide 50. In addition, as illustrated in FIGS. 8 to 10B, the interval adjustment unit 20 includes a rotating unit 45 which rotates due to a rotation of the interval adjustment motor 19, a belt 48 which transmits a rotating force of the rotating unit 45 to rotating units 47*a*, 47*b*, 47*c*, and 47*d*, a screw unit 49*a* which is connected to the rotating unit 47*c*, and can rotate, and a screw unit 49*b* which is connected to the rotating unit 47*d*, and can rotate.

With such a configuration, the interval adjustment unit 20 according to the embodiment rotates the screw units 49*a* and 49*b* by rotating the interval adjustment motor 19, and can adjust a position of the second unit 44 in the vertical direction with respect to the first unit 43.

Subsequently, the collecting unit 13 of the recording apparatus 1 according to the embodiment will be described.

Figure 15:
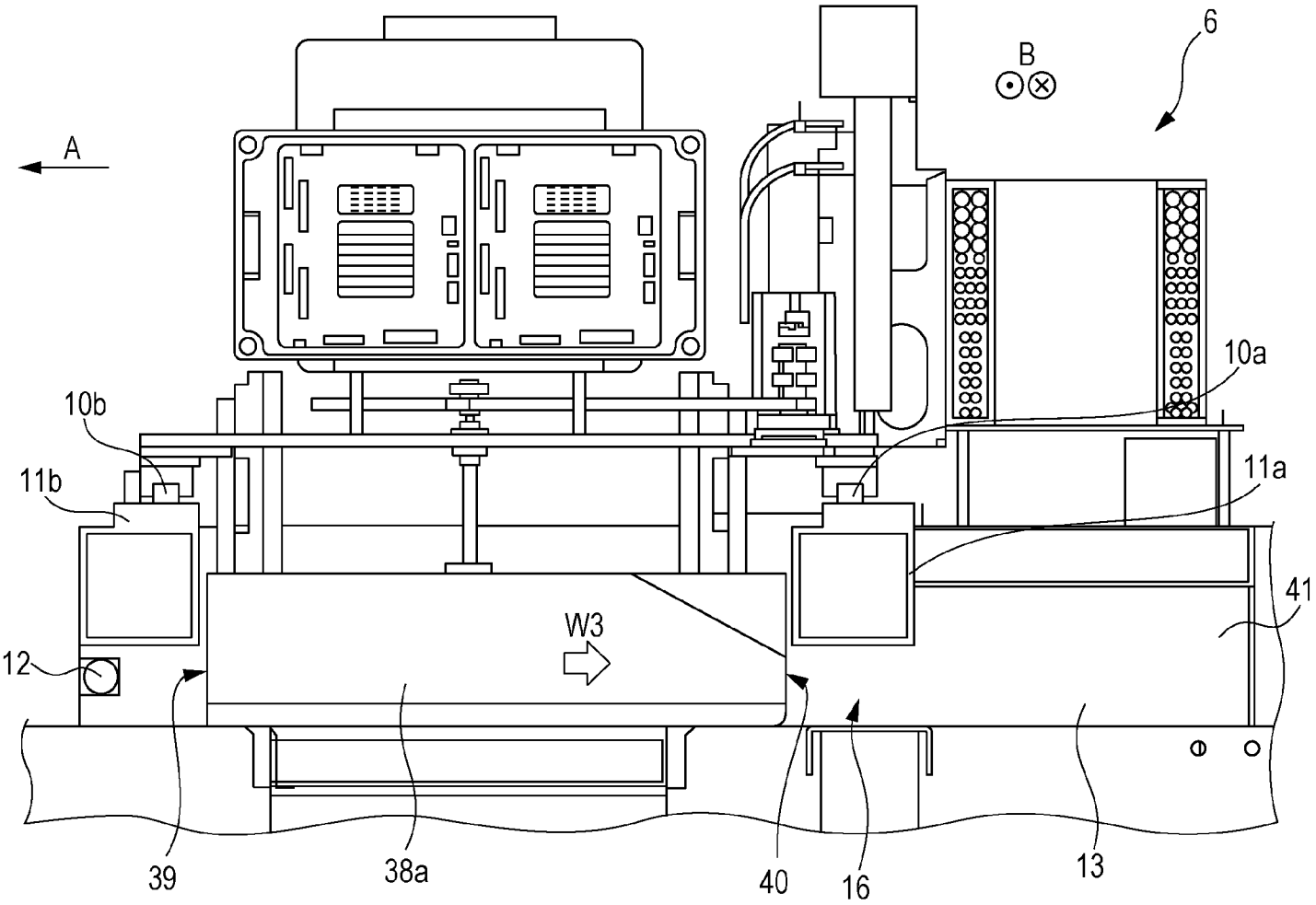
FIG. 15 is a schematic side sectional view which illustrates a positional relationship of a carriage in the recording apparatus according to the embodiment of the invention.
Figure 16:
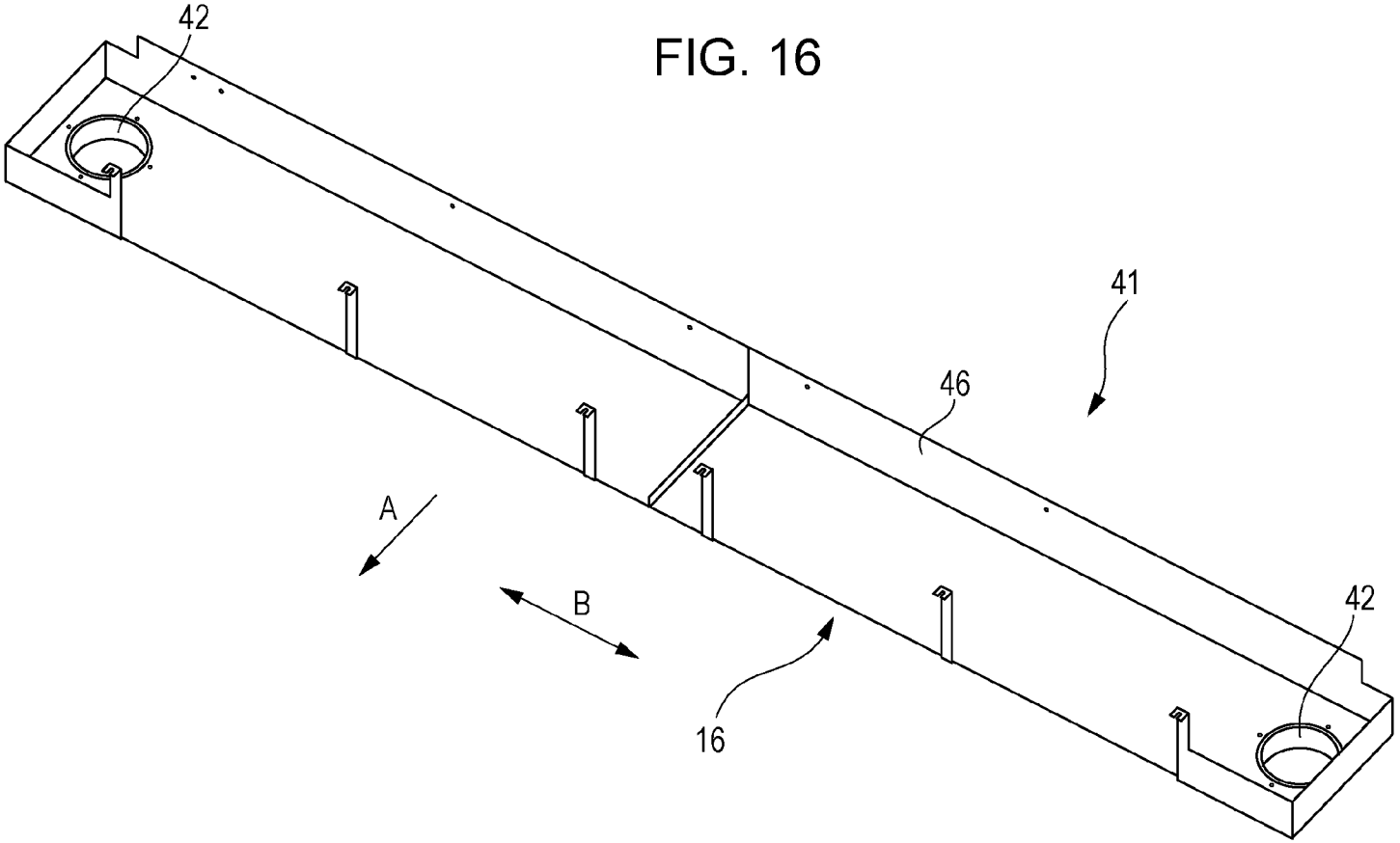
FIG. 16 is a schematic perspective view which illustrates a collecting unit of the recording apparatus according to the embodiment of the invention.

Here, FIG. 15 is a schematic side sectional view of main portions of the recording apparatus 1 according to the embodiment for describing a positional relationship among the collecting unit 13, the carriage 6, and the air blowing unit 12. FIG. 16 is a schematic perspective view which illustrates a collecting chamber 41 in the collecting unit 13.

As illustrated in FIG. 15, in the transport direction A, the air blowing unit 12 which can blow an air current W3 toward the upstream side in the transport direction A is provided on the downstream side of a movement region (corresponding to recording region) of the carriage 6 in the reciprocating direction B, and the collecting unit 13 is provided on the upstream side of the movement region. By arranging the collecting unit 13 in this manner, it is possible to efficiently collect mist of ink which occurs in the recording region.

As described above, the recording apparatus 1 according to the embodiment includes the suctioning fan 15, as illustrated in FIG. 5, and the suctioning fan 15 is connected to the collecting chamber 41 through a duct 42 which is illustrated in FIG. 16. In other words, the collecting unit 13 includes the suctioning fan 15 as the suctioning unit which generates an air current from the collecting port 16 toward the inside of the collecting unit 13. For this reason, the recording apparatus 1 according to the embodiment can preferably prevent mist from flowing back from the collecting unit 13.

As described above, the recording apparatus 1 according to the embodiment can efficiently induce mist toward the collecting unit 13, since the air blowing unit 12 which blows air toward the collecting port 16 from the outside of the collecting unit 13 is provided.

As described above, the recording apparatus 1 according to the embodiment has a configuration in which the recording head 7 can eject ink while reciprocating in the reciprocating direction B; however, the suctioning fan 15 can maintain a suctioning state in both situations of in the middle of moving in the reciprocating direction B and in the middle of stopping of the carriage 6 (recording head 7) under a control of the control unit 23. That is, it is possible to set the suctioning fan 15 to a constant suctioning state. Since there is no shift in ink ejecting position even when an air current is generated in the collecting unit 13 using the suctioning fan 15, the recording apparatus 1 according to the embodiment can preferably suppress flowing back of ink mist from the collecting unit 13 while suppressing a shift in ejecting position of ink which is ejected from the recording head 7 by setting the suctioning fan 15 to the constant suctioning state.

In addition, as described above, the recording apparatus 1 according to the embodiment is provided with the air blowing unit 12 which generates an air current from the outside of the collecting unit 13 toward the collecting port 16, and the collecting unit 13 includes the suctioning fan 15 which generates an air current from the collecting port 16 toward the inside of the collecting unit 13; however, it is configured so that a wind velocity of an air current which goes from the outside of the collecting unit 13 toward the collecting port 16, by interposing the collecting port 16 is lower than a wind velocity of an air current which goes from the collecting port 16 toward the inside of the collecting unit 13. That is, it is configured so that the wind velocity of the air current which goes from the collecting port 16 toward the inside of the collecting unit 13 is higher than the wind velocity of the air current which goes from the outside of the collecting unit 13 toward the collecting port 16, based on a position of the collecting port 16. For this reason, the recording apparatus 1 according to the embodiment preferably suppresses backflow of mist of ink from the collecting unit 13 by suppressing a situation in which an air current including mist is incapable of entering the collecting unit 13 as a whole.

As illustrated in FIG. 15, the collecting unit 13 according to the embodiment has a configuration in which the collecting chamber 41 is formed by mounting the pipe 11*a* which configures a top face on a base portion 46 which is illustrated in FIG. 16, which configures a constituting region of the collecting port 16, and each face other than a top face; however, it is not limited to such a configuration.

In addition, the invention is not limited to the above described embodiment, and it is needless to say that the invention can be variously modified in the scope of the invention which is described in claims, and those are also included in the scope of the invention.

Hitherto, the invention has been described based on specific embodiments. Here, the invention will be collectively described once again.

A liquid ejecting apparatus 1 in a first aspect of the invention includes a carriage 6 which can move in the reciprocating direction B, in which the carriage 6 is provided with an ejecting unit 7 which ejects liquid, a circuit board which inputs a signal to the ejecting unit 7, and a fan 21 which can blow air toward the circuit board, and the carriage includes a separator 37 which separates a path through which mist which occurs along with ejecting of the liquid from the ejecting unit 7 reaches the fan 21.

According to the aspect, the carriage 6 which includes the separator 37 which separates a path through which mist which occurs along with ejecting of the liquid from the ejecting unit 7 reaches the fan 21 is provided. For this reason, it is possible to prevent mist of liquid which is ejected from the ejecting unit 7 from reaching the fan 21. Accordingly, it is possible to prevent mist of liquid which is ejected from the ejecting unit 7 from being blown against the circuit board due to the fan 21.

In the liquid ejecting apparatus 1 according to a second aspect of the invention, in the first aspect, the separator 37 is provided in the carriage 6 by being arranged so as to surround a configuration unit of the fan 21 when viewed in an ejecting direction of the liquid.

According to the aspect, the separator 37 is provided in the carriage 6 by being arranged so as to surround the configuration unit of the fan 21 such as a sub-carriage 5 when viewed in the ejecting direction of the liquid. For this reason, it is possible to prevent mist of liquid which is ejected from the ejecting unit 7 from reaching the fan 21, in all directions which intersect the ejecting direction of liquid. Accordingly, it is possible to preferably prevent mist of liquid which is ejected from the ejecting unit 7 from being blown against the circuit board due to the fan 21.

In the liquid ejecting apparatus 1 according to a third aspect of the invention, in the first or second aspect, the separator 37 includes convection generation units 38*a* and 38*b* which are formed at both ends in the reciprocating direction B in a shape in which at least a part thereof projects in the reciprocating direction B.

According to the aspect, the separator 37 includes the convection generation units 38*a* and 38*b* which are formed at both ends in the reciprocating direction B in a shape in which at least a part thereof projects in the reciprocating direction B. For this reason, the separator 37 can suppress diffusion of mist by causing the convection generation units 38*a* and 38*b* on the rear side in the reciprocating direction B to generate convection in the middle of a movement of the carriage 6 in the reciprocating direction B. Accordingly, it is possible to preferably prevent mist of liquid which is ejected from the ejecting unit 7 from being blown against the circuit board due to the fan 21.

In the liquid ejecting apparatus 1 according to a fourth aspect of the invention, in the third aspect, the convection generation units 38*a* and 38*b* are provided so as to extend in a direction A which intersects the ejecting direction of the liquid and the reciprocating direction B.

According to the aspect, the convection generation units 38*a* and 38*b* are provided so as to extend in a direction A which intersects the ejecting direction of the liquid and the reciprocating direction B. For this reason, the separator 37 can preferably suppress diffusion of mist by generating convection along the direction A in the convection generation units 38*a* and 38*b* on the rear side in the reciprocating direction B. Accordingly, it is possible to preferably prevent mist of liquid which is ejected from the ejecting unit 7 from being blown against the circuit board due to the fan 21.

In the liquid ejecting apparatus 1 according to a fifth aspect of the invention, in any one of the first to fourth aspects, the separator 37 is provided in the carriage 6 so that at least a part thereof is arranged at a position between the ejecting unit 7 and the fan 21, when viewed in a direction intersecting the ejecting direction of the liquid.

According to the aspect, the separator 37 is provided in the carriage 6 so that at least a part thereof is arranged between the ejecting unit 7 and the fan 21, when viewed in a direction intersecting the ejecting direction of the liquid. For this reason, it is possible to preferably prevent mist of liquid which is ejected from the ejecting unit 7 from reaching the fan 21. Accordingly, it is possible to preferably prevent mist of liquid which is ejected from the ejecting unit 7 from being blown against the circuit board due to the fan 21.

In the liquid ejecting apparatus 1 according to a sixth aspect, in any one of the first to fifth aspects, rails 10*a* and 10*b* which are provided so as to extend in the reciprocating direction B are further included, in which the carriage 6 includes a first unit 43 which is supported by the rails 10*a* and 10*b*, and a second unit 44 which can move along the ejecting direction of the liquid with respect to the first unit 43, and the ejecting unit 7 and the separator 37 are provided in the second unit 44.

According to the aspect, the carriage 6 includes the first unit 43 which is supported by the rails 10*a* and 10*b*, and the second unit 44 which can move along the ejecting direction of the liquid with respect to the first unit 43, and the ejecting unit 7 and the separator 37 are provided in the second unit 44. For this reason, since it is possible to adjust an interval between the ejecting unit 7 and a medium (or, interval between ejecting unit 7 and support unit of medium), and to maintain a positional relationship between the ejecting unit 7 and the separator 37 even when the interval is adjusted, it is possible to preferably prevent mist of liquid which is ejected from the ejecting unit 7 from reaching the fan 21.

The entire disclosure of Japanese Patent Application No. 2015-064611, filed Mar. 26, 2015 is expressly incorporated by reference herein.

What is claimed is:

1. A liquid ejecting apparatus comprising:

a carriage which is configured to move in a reciprocating direction, wherein the carriage is provided with an ejecting unit which ejects liquid, a circuit board which inputs a signal to the ejecting unit, and a fan which is configured to blow air toward the circuit board, and wherein the carriage includes a separator which separates a path through which mist which occurs along with ejecting of the liquid from the ejecting unit reaches the fan, wherein the separator is provided in the carriage by being arranged so as to surround a configuration unit of the fan when viewed in an ejecting direction of the liquid.

2. The liquid ejecting apparatus according to claim 1, wherein the separator includes convection generation units which are formed at both ends in the reciprocating direction in a shape in which at least a part thereof projects in the reciprocating direction.

3. The liquid ejecting apparatus according to claim 2, wherein the convection generation unit is provided so as to extend in a direction intersecting the ejecting direction of the liquid and the reciprocating direction.

4. The liquid ejecting apparatus according to claim 1, wherein the separator is provided in the carriage so that at least a part thereof is arranged between the ejecting unit and the fan, when viewed in a direction intersecting the ejecting direction of the liquid.

5. The liquid ejecting apparatus according to claim 1, further comprising:

a rail which is provided so as to extend in the reciprocating direction, wherein the carriage includes a first unit which is supported by the rail, and a second unit which is configured to move along the ejecting direction of the liquid with respect to the first unit, and wherein the ejecting unit and the separator are provided in the second unit.

* * * * *